US006553199B2

(12) United States Patent
Ishiyama et al.

(10) Patent No.: US 6,553,199 B2
(45) Date of Patent: Apr. 22, 2003

(54) CHARGING DEVICE, PROCESS CARTRIDGE AND IMAGE FORMING APPARATUS

(75) Inventors: Harumi Ishiyama, Numazu (JP); Yasunori Chigono, Susono (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,810

(22) Filed: Oct. 19, 2001

(65) Prior Publication Data

US 2002/0106216 A1 Aug. 8, 2002

(30) Foreign Application Priority Data

Oct. 20, 2000 (JP) ..... 2000-321196

(51) Int. Cl.[7] ..... G03G 15/00; G03G 15/02

(52) U.S. Cl. ..... 399/174; 361/225; 399/176

(58) Field of Search ..... 399/174, 176, 399/149, 150; 430/902, 105, 108.1; 361/221, 225

(56) References Cited

U.S. PATENT DOCUMENTS

| | | | | |
|---|---|---|---|---|
| 5,579,095 A | | 11/1996 | Yano et al. | 399/175 |
| RE35,581 E | | 8/1997 | Nakamura et al. | 361/225 |
| 5,754,927 A | | 5/1998 | Ishiyama et al. | 399/176 |
| 5,809,379 A | | 9/1998 | Yano et al. | 399/159 |
| 5,822,659 A | | 10/1998 | Ishiyama et al. | 399/175 |
| 6,081,681 A | | 6/2000 | Nagase et al. | 399/174 |
| 6,128,456 A | | 10/2000 | Chigono et al. | 399/176 |
| 6,134,407 A | | 10/2000 | Ishiyama et al. | 399/174 |
| 6,212,346 B1 | | 4/2001 | Hirabayashi et al. | 399/176 |
| 6,289,190 B1 | | 9/2001 | Amamiya et al. | 399/174 |
| 6,343,199 B1 | * | 1/2002 | Kodama | 361/225 |
| 6,389,254 B2 | * | 5/2002 | Ishiyama et al. | 399/174 |

FOREIGN PATENT DOCUMENTS

| | | | |
|---|---|---|---|
| JP | 63-149669 | | 6/1988 |
| JP | 6-3921 | | 1/1994 |
| JP | 2000-81752 | * | 3/2000 |
| JP | 2001-42605 | | 2/2001 |
| JP | 2001-188404 | | 7/2001 |

* cited by examiner

*Primary Examiner*—Sophia S. Chen
(74) *Attorney, Agent, or Firm*—Fitzpatrick, Cella, Harper & Scinto

(57) ABSTRACT

A charging device, suitable for use in an electrophotographic image forming apparatus, is formed of an object to be charged, and a roller-shaped charging member disposed in contact with the object via electroconductive particles and supplied with a voltage to charge the objects. The charging member has a surface layer including an elastic foam and is moved with a surface speed difference relative to the object. The charging member has surface cavities having an average diameter of 5 to 150 $\mu$m and occupying an area percentage of 50 to 90%. An image forming apparatus and a process cartridge therefor including the charging device are also provided.

37 Claims, 5 Drawing Sheets

CHARGING DEVICE, PROCESS CARTRIDGE AND IMAGE FORMING APPARATUS

FIELD OF THE INVENTION AND RELATED ART

The present invention relates to a charging device for use in an image forming apparatus, such as a copying machine and a printer, and a process-cartridge and an image forming apparatus including such a charging device.

In recent years, in view of advantages, such as a lower ozone-generation characteristic and a lower power consumption, compared with a corona charging device, a contact-scheme charging device (i.e., a contact charging device) including a charging member supplied with a voltage and abutted against an object to be charged for charging the object to be charged has been commercialized.

More specifically, such a contact charging device includes an electroconductive charging member of a roller type (charging roller), a fur brush type, a magnetic brush type or a blade type, and the charging member is caused to contact an object to be charged, such as an image-bearing member, and is supplied with a prescribed bias voltage to charge the surface of the object, to be charged (hereinafter sometimes simply called a "charged object" or an "object") to a prescribed potential of a prescribed polarity.

In contact-charging of an object, two types of charging mechanisms (or charging principles) operate simultaneously, i.e., (1) a discharge-charging mechanism and (2) a direct injection charging mechanism. The characteristics of each contact device are determined depending on which of the two mechanisms is predominant. The two representative charging characteristics (potential-applied voltage characteristics) are represented by curves 70A and 70B in FIG. 7.

(1) A discharge-based Charging Mechanism

This is a mechanism in which the surface of a charged object is charged by electrical discharge occurring across a minute gap between the contact charging member and the charged object. In the discharge-based contact charging system, there is a threshold voltage so that the contact charging member has to be supplied with a voltage larger than the potential level to which the charged object is to be charged. Further, in reality, the occurrence of discharge products and active ions, such as ozone, and difficulties therewith are inevitable in principle, while the amounts of such discharge products are much smaller than in the corona charging device.

Among the known contact charging schemes, a roller charging scheme using a charging roller as the contact charging member is preferred in view of charging stability and has been widely practiced, but the charging mechanism in the roller charging scheme is predominantly governed by the discharge-based charging mechanism.

More specifically, a charging roller is generally formed of an electroconductive or medium-resistivity rubber or foamed material. In some charging rollers, the rubber or foamed layer is included in a laminate structure to obtain a desired property. Such a charging roller is provided with an elasticity so as to obtain a constant contact with the charged object and, as a result thereof, exhibits a large frictional resistance. Accordingly, in many cases, the charging roller is driven so as to follow the movement of or with a relative speed difference with the charged object. Accordingly, the occurrence of a locally non-contact state is inevitable due to the shape irregularity of the roller and the attachment of foreign matter onto the charged object, and as a result, the charging mechanism in the roller charging scheme is dominantly governed by the discharge-based charging scheme.

Referring to a specific example showing a chargeability characteristic as represented by a dashed line 70A in FIG. 7 wherein an organic electrophotographic photosensitive member having a 25 $\mu$m-thick photosensitive layer is charged by a charging roller pressed against thereto, the surface potential on the photosensitive member begins to increase when a voltage in excess of, e.g., ca. 500 volts is applied to the charging roller, and at higher applied voltages, the surface potential of the photosensitive member increases linearly at a slope of 1 with respect to the applied voltage. The threshold voltage (of ca. 500 volts on the curve 70A in FIG. 7) may be referred to as a charge initiation voltage (Vth).

Accordingly, in such a roller charging scheme, in order to obtain a surface potential Vd required for an electrophotographic process, it is necessary to apply an additional voltage of Vd+Vth to the charging roller. Such a charging scheme of applying only a DC voltage to a contact charging member and to a charged object may be generally referred to as a "DC-charging scheme".

However, according to the DC-charging scheme, it has been difficult to charge the photosensitive member to a constant desired potential value since the resistance of the contact charging member is changed due to changes in environmental conditions, etc., and also Vth is changed due to changes in photosensitive layer thickness of the electrophotographic photosensitive member as the charged object.

For overcoming these difficulties to achieve a further uniform charging scheme, there has been used a so-called "AC-charging scheme" as disclosed in JP-A 63-149669, wherein a charged object is charged by applying an oscillating voltage obtained by superposing a DC voltage component corresponding to a desired potential Vd with an AC voltage component having a peak-to-peak voltage of at least Vth×2. This scheme utilizes the potential-smoothing effect of AC voltage superposition, and the potential of the charged object is changed to Vd, which is a central value of the oscillating voltage and is less affected by an external change, such as an environmental change.

However, in the above-mentioned contact charging scheme, the essential charging mechanism thereof relies on a discharge from a charging member onto a charged object, and the voltage required for the charging amounts to a value of (photosensitive member surface potential+at least a discharge threshold voltage), thus inevitably generating more or less amounts of discharge products, such as ozone.

Moreover, the AC-charging scheme for uniform charging performance has resulted in other difficulties, such as an increased amount of discharge products such as ozone, vibration noise (AC-charging noise) caused between the contact charging member and the charged object under the application of the AC electric field therebetween, and noticeable surface degradation of the charged object due to the discharge.

(2) Direct Injection Charging Mechanism

This is a charging mechanism as disclosed, e.g., in JP-A 6-3921, wherein charges are directly injected from a contact charging member to a charged object to charge the object.

More specifically, in the direct injection charging scheme, the object is charged with charges directly injected from a medium resistivity contact charging member to the object surface without relying on a discharge phenomenon or discharge mechanism. Accordingly, even at an applied voltage below a discharge threshold voltage, the object can be charged to a potential comparable to the applied potential (an example of a chargeability characteristic (potential-applied voltage characteristic) is represented by a solid line 70B in FIG. 7). The direct injection charging mechanism is substantially free from the occurrence of ions or discharged products and therefore free from the difficulties accompanying it.

More specifically, in such a direct injection charging system, a contact charging member, such as a charging roller, a charging brush or a charging magnetic brush, is supplied with a voltage to inject charges at a trap energy level or to a charge retention member such as electroconductive particles of a charge injection layer. As the discharge phenomenon is not dominant, only a voltage comparable to a surface potential level of a charged object is required to be applied to the charging member. Thus, this method is free from the occurrence of discharge by-products, such as ozone.

Particularly, in the case of a porous roller such as a sponge roller coated with electroconductive fine particles as a contact charging member, it becomes possible to accomplish a very dense contact between the contact charging member and the charged object, thereby easily obtaining good charging performance.

Further, by rotating the charging member with a relative surface speed difference, it becomes possible to obtain a better charging performance by a simple organization of the contact charging device according to the injection charging mechanism, while obviating the occurrence of discharge products, such as ozone.

However, such a contact charging system according to the direct injection charging scheme is still accompanied by the difficulty that a toner, having slipped by a cleaning section, is gradually accumulated on the charging roller to lower the charging performance. Particularly, in, a so-called cleanerless (image forming) system lacking an independent cleaning means for recovering and storing a portion of toner (transfer-residual toner) remaining on a photosensitive member (charged object) after a transfer step and prior to the primary charging by such a contact charging member, wherein the developing means is expected to also function as a cleaning means, the accumulation of the transfer-residual toner is a serious concern, thus rendering this method liable to cause a more frequent lowering in charging performance.

For providing an improvement to the above-mentioned problem, JP-A 2001-188404 has proposed a charging roller having surface concave cells giving a total cell edge perimeter per unit area of 15 mm/mm$^2$ to 60 mm$^2$ so as to improve the charging performance. However, further improvement in charging performance is desired for a long period of the charging operation.

SUMMARY OF THE INVENTION

An object of the present invention is to provide a charging device of the contact charging scheme excellent in uniform charging performance and substantially free from the occurrence of discharge by-products, such as ozone.

Other objects of the present invention are to provide an electrophotographic image forming apparatus including a photosensitive member and such a charging device for charging the photosensitive member according to the direct charge-injection charging scheme while retaining a stable charging performance for a long period, thereby providing images free from charging irregularity even in a long period of image formation and a process-cartridge including such a charging device to be incorporated in such an electrophotographic image forming apparatus.

According to the present invention, there is provided a charging device, including: an object to be charged, and a roller-shaped charging member disposed in contact with the object via electroconductive particles and supplied with a voltage to charge the object, the charging member having a surface layer comprising an elastic foam and moved with a surface speed difference relative to the object, wherein the charging member has surface cavities having an average diameter of 15 to 150 $\mu$m and occupies an area percentage of 50 to 90%.

According to the present invention, there is further provided a process-cartridge, comprising an electrophotographic photosensitive member and a charging device including a roller-shaped charging member and integrally supported to form a cartridge which is detachably mountable to a main assembly of an image forming apparatus, wherein the charging device is disposed in contact with the photosensitive member via electroconductive particles and supplied with a voltage to charge the photosensitive member, the charging member has a surface layer comprising an elastic foam and is moved with a surface speed difference relative to the photosensitive member, wherein the charging member has surface cavities having an average diameter of 5 to 150 $\mu$m and occupies an area percentage of 50 to 90%.

The present invention further provides an image forming apparatus, comprising an electrophotographic photosensitive member, a charging device including a charging member disposed in contact with the photosensitive member via electroconductive particles and supplied with a voltage to charge the photosensitive member, exposure means for exposing the photosensitive member to light to form an electrostatic latent image on the photosensitive member, developing means for developing the electrostatic latent image with a developer to form a toner image on the photosensitive member, and transfer means for transferring the toner image onto a transfer receiving material, wherein the charging member has a surface layer comprising an elastic foam and is moved with a surface speed difference relative to the photosensitive member, wherein the charging member has surface cavities having an average diameter of 5 to 150 $\mu$m and occupies an area percentage of 50 to 90%.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
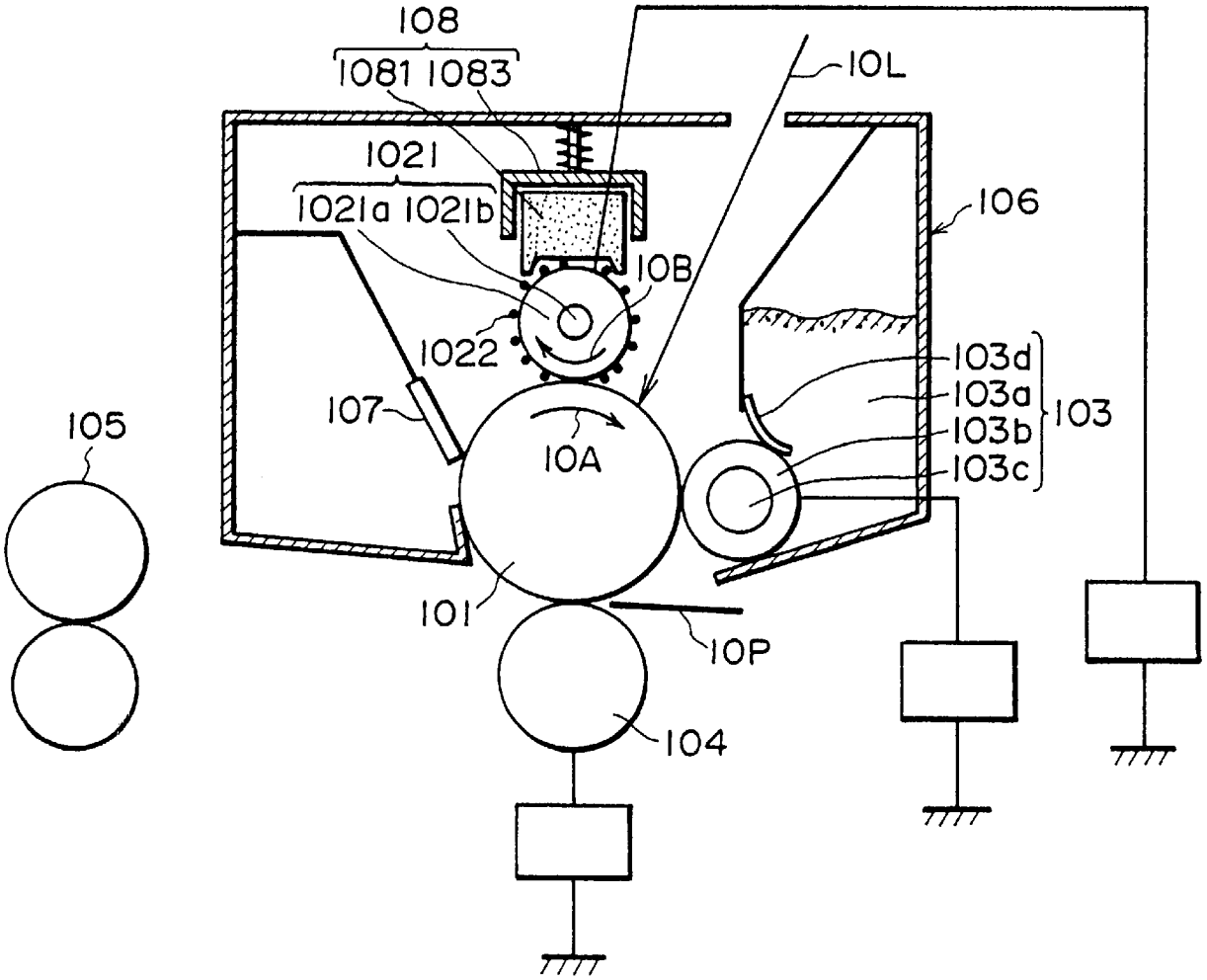
FIG. 1 illustrates an embodiment of the image forming apparatus according to the invention (used in Example 1).

According to the present invention, there is provided a type of charging device including a roller-shaped charging member (charging roller) having a surface layer comprising an elastic foam disposed in contact with an object to be charged to surface-charge the object.

Examples of the object to be charged by using the charging device of the present invention may include image-bearing members used in an electrophotographic apparatus, an electrostatic recording apparatus and a magnetic recording apparatus. Among these, the effect of the present invention is particularly remarkably exhibited in the case where an electrophotographic photosensitive member used as an image-bearing member of an electrophotographic apparatus is used as an object to be charged.

The charging member has surface cavities occupying an area percentage (surface cavity percentage) of 50–90%, though at least 60% is preferred, and more preferably 70% or higher. Below 50%, the surface movement of the charging member is less active, and causes insufficient friction of the developer (toner) when used in electrophotography. On the other hand, in excess of 90%, the framework material becomes insufficient so that it is difficult for the elastic foam to function as a charging member.

Particularly when used in a cleanerless image forming apparatus wherein a larger amount of transfer residual toner is moved to the charging device, it becomes difficult to sufficiently retain the transfer residual toner at a roller surface cavity percentage of below 50% so that the triboelectrification of the transfer residual toner is liable to be insufficient.

The surface cavity percentage values referred to herein have been determined based on a real ratios between cavities and portions outside the cavities on enlarged photographs (at a magnification of 200) of charging member surfaces.

The charging member should have surface cavities showing an average cavity diameter of at least 5 $\mu$m and at most 150 $\mu$m. If the average cavity diameter is below 5 $\mu$m, when used in electrophotography, it becomes difficult to sufficiently carry the developer (toner) and electroconductive particles in the cavities so that the toner cannot be sufficiently charged by one pass through the nip between the charging roller and the photosensitive member because of a reduced opportunity for triboelectrification. On the other hand, in excess of 150 $\mu$m, the contact with the photosensitive member becomes insufficient, so that the charging member is liable to fail insufficiently uniform direct-injection charging.

Particularly, in the case of using the charging member in a cleanerless image forming apparatus including a developing means also functioning as a means for recovering the transfer residual toner remaining on the photosensitive member (as the object to be charged), the surface cavities on the charging member may preferably have an average diameter of 20 to 100 $\mu$m. Below 20 $\mu$m, it is difficult to sufficiently carry the transfer residual toner and electroconductive particles in the cavities, thus reducing the opportunity of friction, whereby it becomes difficult for the toner to acquire a sufficient charge by a single pass through the nip between the roller and the photosensitive member. Further, in the cleanerless apparatus wherein a larger amount of transfer residual toner is present, the uniformity of contact with the photosensitive member becomes insufficient at an average cavity diameter exceeding 100 $\mu$m, so that uniform injection charging becomes difficult.

Such an elastic foam satisfying the above-mentioned surface cavity percentage and average cavity requirements may be produced through methods as described below.

In one method, a mixture of particles soluble in a certain solvent with a resistivity-adjusted polymeric material is shaped, and the shaped body is left to stand within such a solvent to dissolve the particles, thereby obtaining a foam body.

In another method, a resistivity-adjusted liquid polymeric material containing a foaming agent is cast into a mold and subjected to foaming, thereby obtaining a foam body.

In still another method, a polymeric material containing encapsulated foaming particles is subjected to foaming, thereby obtaining a foam body.

In yet another method, a liquid polymeric material bubbles under stirring, to obtain a foam body.

Among the above-mentioned methods, the method of selective dissolution of particles is easy for obtaining a desired cavity diameter by adjustment of particle sizes. Also, the method of using capsular foaming particles is easy for adjusting the cavity diameter through adjustment of the capsule sizes.

The average surface cavity diameters described herein are based the values of maximum chord lengths of at least 100 cavities selected by observation through an optical or electron microscope and are determined as number-basis average values.

It is very difficult to form all the surface cavities of a charging member in true circles giving an average shorter/longer axis ratio (b/a)=1. Actually, it is only possible to obtain a charging member surface having surface cavities giving an average shorter/longer axis ratio $b/a<1$. However, in order to provide a better injection charging performance, it is preferred to form cavities closer to true circles, more specifically giving an average shorter/longer axis ratio $b/a \geqq 0.2$.

Herein, the average shorter/longer axis ratio b/a is determined based on shorter/longer axis ratios b/a of at least 100 cavities selected by microscopic observation while taking a maximum chord length as a and a minimum FERE diameter as b, and a number-average of b/a values is taken as an average shorter/longer axis ratio b/a.

Among the above methods, the method of using capsules and the method of foaming in molds can relatively easily provide cavities close to true circles.

As mentioned above, the charging device of the present invention includes a roller-shaped charging member (charging roller) and electroconductive particles present at contacting surfaces between the charging member and an object to be charged. More specifically, on the charging roller surface, electroconductive particles may be applied in advance, and an object such as an electrophotographic photosensitive member is charged by the charging roller in the state of carrying such electroconductive particles. As the electroconductive particles are present between the object and the charging roller which are moved with a relative speed difference therebetween, a highly contacting state is attained. For example, the charging roller may be driven in rotation or fixed to provide a speed difference between the photosensitive member and the charging roller. The charging roller may preferably be rotated to provide a surface moving direction which is opposite to that of the photosensitive member surface at the contact position.

It is also important for the charging roller to function as an electrode. More specifically, the charging roller is required to show a sufficiently low resistivity to charge the object such as electrophotographic photosensitive member in addition to an elasticity for keeping a sufficient contact state. On the other hand, it is necessary to prevent the leakage of voltage even at defects, such as pinholes, on the photosensitive member. Accordingly, for attaining sufficient charging performance and leakage resistance, the charging roller may preferably show a resistance in the range of $10^4$–$10^7$ ohm when measured in a state of being pressed against an aluminum drum of 30 mm in diameter at a total load of 1 kg/200 mm under the application of 100 volts between the core metal of the charging roller and the aluminum drum.

Too low a hardness of the charging roller results in a poor contact state because of an unstable shape, and too high a hardness results in failure to ensure a contact nip between the charging roller and the object and microscopically poor contact with the object surface. An Asker C hardness in the range of 25–50 degrees is preferred.

A charging roller for charging an electrophotographic photosensitive member as an object to be charged may for example be prepared in a roller shape from a so-called electroconductive rubber foam-forming composition comprising an elastomer, a foaming agent, an electroconductivity-imparting agent, and optionally, a vulcanizer, a vulcanization promoting agent, and rubber additives, such as an oil, a plasticizer, zinc white, stearic acid, calcium carbonate, calcium carbonate and magnesia.

Examples of the elastomer may include: EPDM rubber (ethylene-propylene-diene terpolymer rubber), urethane rubber, nitrile rubber, silicone rubber, chloroprene rubber, epichlorohydrin rubber, butadiene rubber, styrene-butadiene rubber, isoprene rubber, natural rubber, butyl rubber, and acrylic rubber. These elastomers may be used singly or in combination of two or more species.

The foaming agent may be appropriately selected from known inorganic and organic foaming agents. The inorganic foaming agents may for example include: potassium hydrogencarbonate, ammonium hydrogencarbonate and sodium boron hydride; and the organic foaming agents may for example include: azodicarbonamide, azobisisobutyronitrile, barium azodicarboxylate, dinitropentamethylenetetramine, p,p'-oxybis (benzenesulfonylhydrazide), and p-toluenesulfonylhydrazide. These foaming agents may be used singly or in combination of two or more species.

The electroconductivity-imparting agent may appropriately be selected from, e.g., carbon black; powder of metals, such as nickel and copper; powder of metal oxides, such as tin oxide, titanium oxide and zinc oxide, and other electroconductive metal double oxides; and ionic conductive agents inclusive of perchlorates, alkylsulfates, carboxylates of metals, ammonium, etc. These electroconductivity-imparting agents may be used singly or in combination of two or more species, in an amount appropriately selected for providing a conductive rubber foam depending on the species of the electroconductivity-imparting agent used.

By appropriately selecting the species and foaming conditions of the above-mentioned foaming agents and other materials, it is possible to form an elastic surface layer of the charging roller forming surface cavities exhibiting the prescribed average diameter and cavity areal percentage.

Alternatively, it is also possible to form an elastic surface layer having cavities satisfying the prescribed average diameter and cavity areal percentage by casting a material containing no foaming agent into a mold capable of providing such surface cavities to the formed material. It is however preferred to use the above-mentioned method of using a foaming agent in order to provide a desirable elasticity to the entire charging roller.

By adopting the organization of the present invention, it is possible to realize a high charging efficiency not attainable by the scheme of charging an object based on a discharge phenomenon occurring at minute gaps between the object and a contact charging member, thereby providing a photosensitive member as such an object with a potential substantially equal to a potential applied to the charging roller. Thus, only a bias voltage nearly equal to a potential provided to the photosensitive member is required to be applied, thereby realizing a stable and safe charging scheme not relying on the discharge phenomenon.

The electroconductive particles used in the present invention may preferably have a resistivity of at most $10^{12}$ ohm.cm so as to effect charge transfer via the particles. The resistivity values described herein are based on values measured according to the tablet method as follows. A powdery sample of 0.5 g in weight is placed in a cylinder having a bottom area of 2.26 $cm^2$ and sandwiched under a load of 15 kg between upper and lower electrodes. In this state, a voltage of 100 volts is applied between the electrodes to measure a resistance, from which a resistivity is calculated.

In order to realize a good charging uniformity, the electroconductive particles may preferably have an average particle size (diameter) smaller than the average cavity diameter on the charging member surface, more preferably at most 1/10 of the latter.

On the other hand, so as to be stably formed as particles, the electroconductive particles may preferably have an average particle size of at least 10 nm and at least 1/100 of the surface cavity diameter for retaining a good charging performance for a long period of image formation.

Particularly, in the case of using the charging device in an image forming system including an exposure means using scanning laser light capable of digital exposure at individual pixels to form an electrostatic latent image on an electrophotographic photosensitive member, the electroconductive particles may preferably have an average particle size which is not larger than a diameter of each pixel. If the average particle size is larger than each pixel size, the scanning exposure light is liable to cause light scattering at the time of image exposure. Herein, the pixel size refers to a reciprocal of resolution. For example, in the case of an image forming apparatus having a resolution of 600 dpi (dots per inch), the pixel size is calculated as 25400 $\mu$m/600=42.33 $\mu$m.

In the case where the particles are agglomerated, the particle size refers to a size of each particle agglomerate. For calculation of an average particle size, at least 100 particles are selected at random through microscopic observation to measure maximum chord lengths of the respective particles, which are averaged on a number basis to provide an average particle sizes.

The electroconductive particles may comprise conductive inorganic particles, such as metal oxides, alone or a mixture thereof with an organic material, optionally subjected to a surface treatment.

In the case of using the charging device for electrophotography, the electroconductive particles may preferably be colorless or white so as not to obstruct the latent image exposure and in view of a possibility that a portion of the electroconductive particles can be transferred to recording paper from the photosensitive member in color image formation.

On the other hand, the object to be charged may preferably have a surface layer having a volume resistivity of at most $1\times10^{14}$ ohm.cm so as to effect charge-transfer via the electroconductive particles and a volume resistivity of at least $1\times10^{9}$ ohm.cm in the case of an electrophotographic photosensitive member required to retain an electrostatic latent image for some period thereon.

FIG. 1 illustrates an organization of an image forming apparatus including a process-cartridge which in turn includes a charging device of the present invention.

Referring to FIG. 1, the image forming apparatus includes an electrophotographic photosensitive member 101, and a charging roller 1021, a light source (not shown) for emitting scanning laser light 10L, a developing device 103, a transfer charging device 104, a fixing device 105 and a cleaning device 107 disposed to surround the photosensitive member 101. Among these, the photosensitive member (drum) 101, the charging roller 1021, the developing device 103 and the cleaning device 107 are integrally supported to form a process-cartridge 106, which is detachably mountable to a main assembly of the image forming apparatus including the remainder of the above-mentioned members.

The charging roller 1021 is formed of a core metal 1021*b* and a medium-resistivity layer 1021*a* of elastic foam formed thereon. On the surface of the charging roller 1021, electroconductive particles 1022 have been applied in advance by a conductive particle-supply means 108.

The conductive particle-supply means 108 includes a conductive particle-supply member 1081 and a housing 1083 accommodating the conductive particle-supply member 1081. The conductive particle-supply means 108 is disposed above the charging roller 1021 so that a lower surface of the conductive particle-supply member 1081 is caused to contact or be released from an upper surface of the charging roller 1021.

The contact and release of the conductive particle-supply member 1081 with respect to the charging roller 1021 may be effected by using a cam or an electromagnetic coil, so that the conductive particle-supply member 1081 is caused to contact the charging roller 1021 for a prescribed period allowing at least one rotation of the charging roller 1021 during the period of non-image formation to effect the particle supply. The supply of conductive particles 1022 is effected at the time of no image formation. This is because the supply of conductive particles 1022 during the image forming period is liable to cause difficulties, such as light interruption at the exposure position and developing voltage leakage at the developing position when the conductive particles are excessively supplied to be transferred from the conductive roller 1021 onto the photosensitive member 101. The conductive particle-supply member 1081 is a chalk-like solidified chip which has been formed by solidifying the conductive particles 1022 together with a binder and is worn to supply the conductive particles onto the charging roller 1021 surface when abutted against the rotating conductive roller 1021.

By carrying the conductive particles 1022, the conductive roller 1021 can be rotated in an indicated arrow 10B direction with a reduced torque even at a substantial speed difference relative to the photosensitive member 101 rotated in an indicated arrow 10A direction. Owing to the speed difference, an intimate contact state can be ensured between the photosensitive member 101 and the conductive particles 1022 on the charging roller 1021 surface. As a specific organization, the charging roller 1021 may be rotated as shown in FIG. 1 or fixed while the photosensitive member 101 is rotated, thereby providing a speed difference (peripheral speed ratio (%) between the photosensitive member and the charging roller as calculated according to the following formula:

Speed difference (peripheral speed ratio (%))=((charging roller peripheral speed−photosensitive member peripheral speed)/photosensitive member peripheral speed)×100.

In the above formula, the case where the charging roller is rotated following the rotation of the photosensitive member provides a speed difference of 0 (not contemplated in the present invention), and the sign of the charging roller peripheral speed is regarded as "positive" when the charging roller surface is moved in a direction identical to that of the photosensitive member surface at the mutually contacting position (i.e., the contact nip).

It is preferable to move the charging roller in a counter direction with respect to the photosensitive member (i.e., in a surface moving direction opposite to that of the photosensitive member) and more specifically so as to provide a speed difference of from −400% to below −100% as calculated by the above formula. If the speed difference is below −400%, the life of the charging roller is liable to be lowered due to severe friction with the photosensitive member, and if the speed difference is −100% (i.e., in the case where the charging roller is not rotated) or above −100% (i.e., in the case where the charging roller is rotated to provide a surface providing direction identical to that of the photosensitive member), paper dust or residual toner is liable to be accumulated at the nip between the charging roller and the photosensitive member, leading to charging failure in some cases.

By adopting the above organization, it is possible to realize a high charging efficiency not achievable by the conventional roller charging scheme, thereby providing a photosensitive drum with a potential supplied to the charging roller. Thus, only a bias voltage nearly equal to a potential provided to the photosensitive drum is sufficient for achieving a stable and safe charging scheme not relying on the discharge phenomenon.

The thus uniformly surface-charged photosensitive member 101 by means of the charging roller 1021 is then exposed to exposure light 10L which has been intensity modified corresponding to time-serial electric digital image signals carrying objective image data and emitted from exposure means (not shown), such as slit exposure means or laser beam scanning exposure means. As a result, an electrostatic latent image is successively formed on the peripheral surface of the photosensitive member 101 corresponding to the objective image data.

The thus-formed electrostatic latent image is then developed with a toner 103*a* supplied from the developing device 103. The developing device 103 includes a developing sleeve 103*b* enclosing therein a magnet roll 103*c* and a regulating blade 103*d*. The toner 103*a* in the developing device 103 is applied in a layer on the developing sleeve 103*b* while being subjected to layer thickness regulation and charge imparting by the regulating blade 103*d*, and then supplied to a developing position where the toner is used for development of the electrostatic latent image on the photosensitive member 101 to form a toner image thereon.

Then, from a paper supply unit (not shown), a transfer(-receiving) material 10P is applied to between the photosensitive member 101 and the transfer device 104 in synchronism with the rotation of the photosensitive member 101, and the toner image on the photosensitive member 101 is successively transferred onto the transfer material 10P by means of the transfer device 104.

The transfer material 10P having received the transferred toner image is then separated from the photosensitive member surface and introduced to the fixing device 205, followed by fixation, to provide an image product (i.e., a print or a copy), which is discharged out of the image forming apparatus.

The surface of the photosensitive member 101 after the toner image transfer is subjected to cleaning for removal of transfer residual toner by the cleaning device 107, and then subjected to a subsequent image forming cycle.

In the present invention, a plurality of the above-mentioned structural elements inclusive of the charging device of the present invention, and one or more of the photosensitive member 101, the developing device 103 and the cleaning device can be integrally supported and enclosed within a vessel to form a process cartridge, which is detachably mountable to a main assembly of an electrophotographic apparatus, such as a copying machine or a laser beam printer. For example, the charging device of the present invention and the photosensitive member 101 may be integrally supported to form a process cartridge 106, which is detachably mountable to an apparatus main assembly by a guide means, such as rails (not shown), provided to the main assembly.

In the case where the electrophotographic apparatus is used as a copying machine or a printer, the exposure light 10L may be formed as reflected light or transmitted light from an original, or by reading data on the original, converting the data into a signal and then effecting laser beam scanning, driving of an LED array or driving of a liquid crystal shutter array.

Figure 2:
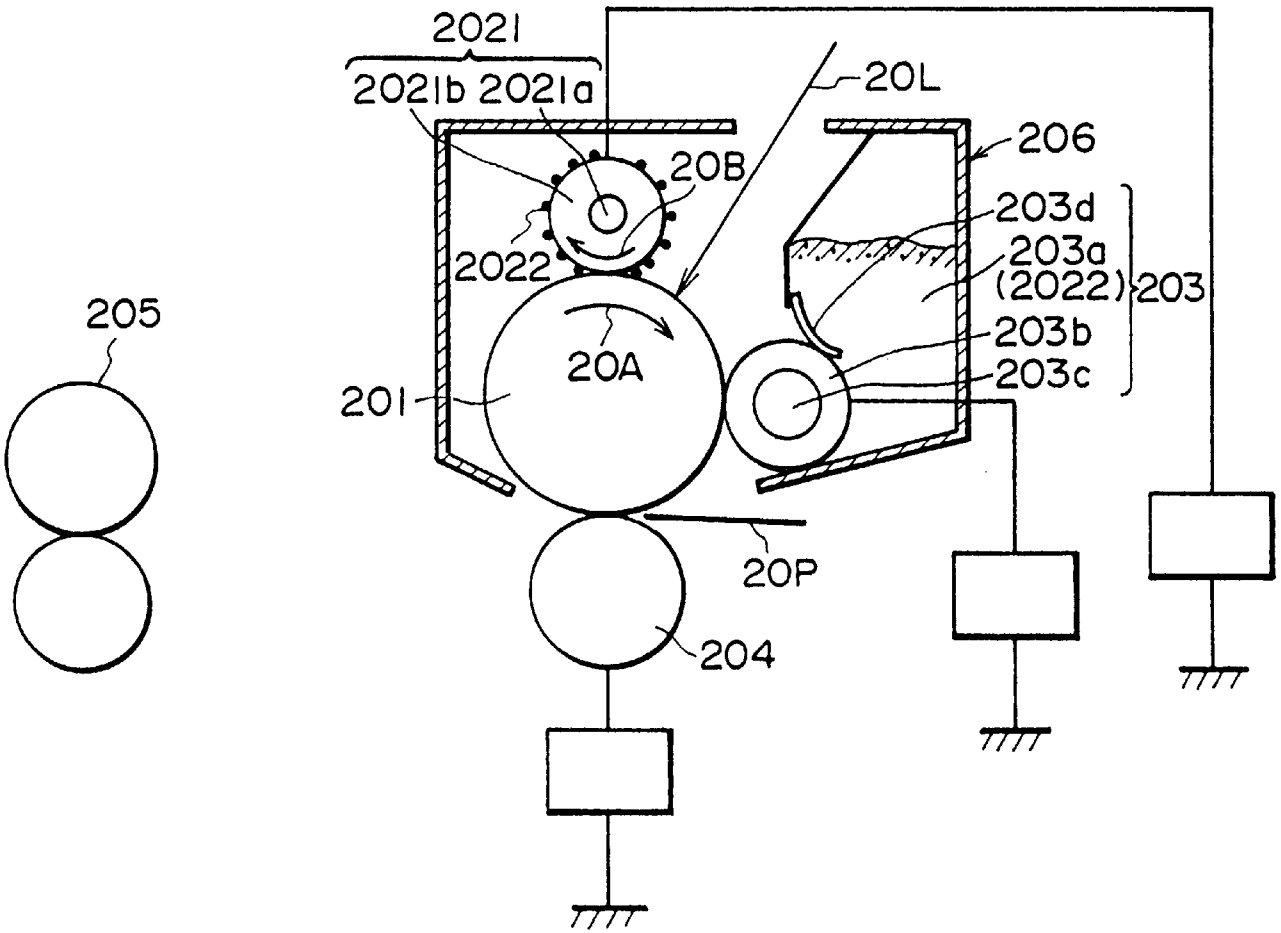
FIG. 2 illustrates another embodiment of the image forming apparatus according to the invention (used in Example 2).

FIG. 2 illustrates another organization of an electrophotographic apparatus including a process-cartridge which in turn includes a charging device of the present invention.

The image forming apparatus shown in FIG. 2 is a so-called cleanerless image forming apparatus allowing a toner recycle without including a cleaning device. The image forming apparatus is also different from the one shown in FIG. 1 in that it does not include a conductive particle-supply device but uses a developer (toner) containing electroconductive particles. This simpler organization is advantageous for reducing the apparatus cost.

Referring to FIG. 2, a photosensitive member 201 as an object to be charged is rotated at a prescribed peripheral speed in an indicated arrow 20A direction. During the rotation, the peripheral surface of the photosensitive member 201 is uniformly charged by the action of a charging roller 2021 according to the present invention rotated in an arrow 20B direction and electroconductive particles 2022 as a charging promoter to a potential nearly equal to a voltage applied to the charging roller 2021.

The charging roller 2021 is formed of a core metal 1021*a* and a medium-resistivity layer 1021*b* of elastic foam formed thereon.

The uniformly surface-charged photosensitive member 201 charged by means of the charging roller 2021 is then exposed to exposure light 20L which has been intensity modified corresponding to time-serial electric digital image signals carrying objective image data and emitted from exposure means (not shown), such as slit exposure means or laser beam scanning exposure means. As a result, an electrostatic latent image is successively formed on the peripheral surface of the photosensitive member 201 corresponding to the image data.

The thus-formed electrostatic latent image is then developed with a toner 203*a* containing charging rollers 2022 and supplied from a developing device 203. The developing device 203 includes a developing sleeve 203*b* enclosing therein a magnet roll 203*c* and a regulating blade 203*d*. The toner 203*a* in the developing device 203 is applied in a layer on the developing sleeve 203*b* while being subjected to layer thickness regulation and charge imparting by the regulating blade 203*d*, and then supplied to a developing position where the toner is used for development of the electrostatic latent on the photosensitive member 201 to form a toner image thereon.

The toner 203*a* contains conductive particles 2022, which are supplied together with the toner 203*a* from the developing device 203 onto the photosensitive member 201 surface and then supplied to the charging roller 2021.

Then, from a paper supply unit (not shown), a transfer(-receiving) material 20P is applied to between the photosensitive member 201 and the transfer device 204 in synchronism with the rotation of the photosensitive member 201, and the toner image on the photosensitive member 201 is successively transferred onto the transfer material 20P by means of the transfer device 204.

The transfer material 20P having received the transferred toner image is then separated from the photosensitive member surface and introduced to a fixing device 205, followed by fixation, to provide an image product (i.e., a print or a copy), which is discharged out of the image forming apparatus.

In the present invention, a plurality of the above-mentioned structural elements inclusive of the charging device of the present invention, and one or more of the photosensitive member 201 and the developing device 203 can be integrally supported and enclosed within a vessel to form a process cartridge, which is detachably mountable to a main assembly of an electrophotographic apparatus, such as a copying machine or a laser beam printer. For example, the charging device of the present invention and the photosensitive member 201 may be integrally supported to form a process-cartridge 206, which is detachably mountable to an apparatus main assembly by a guide means, such as rails (not shown), provided to the main assembly.

In the case where the electrophotographic apparatus is used as a copying machine or a printer, the exposure light 10L may be formed as reflected light or transmitted light from an original, or by reading data on the original, converting the data into a signal and then effecting laser beam scanning, driving of an LED array or driving of a liquid crystal shutter array.

In the image forming operation using the apparatus of FIG. 2, the toner image formed on the photosensitive member 201 is generally transferred onto the transfer material 20P but a portion of toner can remain on the photosensitive member as transfer residual, which alone is an insulating material and is liable to obstruct the charging of the photosensitive member 201 by the charging roller 2021.

In the image forming apparatus of FIG. 2, however, electroconductive particles 2022 optionally applied in advance and supplied together with the toner 203*a* are present on the charging roller 2021 surface. Accordingly, even if an amount of transfer residual toner is brought to a contact position between the charging roller 2021 and the photosensitive member 201, the good contact state and low contact resistance between the charging roller 2021 and the photosensitive member 201 can be ensured due to the co-presence of the conductive particles 2022, thus allowing the intended direct-injection charging of the photosensitive member 201.

The transfer residual toner brought to the contact position between the charging roller 2021 and the photosensitive member 201 is not substantially introduced into the surface cavities of the charging roller 2021, but charged to an intended polarity through friction with the photosensitive member 201 and the conductive particles 2022, and then discharged from the charging roller 2021 surface to the developing position, where the toner is recovered or used for development in the subsequent developing step.

By repeating the above steps, the charging roller surface is retained in a state allowing stable contact charging while effecting the toner recycling, whereby good images can be formed over a long period while retaining uniform charging performance.

The organizations of the process cartridge and the image forming apparatus shown in FIGS. 1 and 2 are set forth for example, and another organization of the process cartridge and the image forming apparatus can be provided by using a charging device of the present invention.

Next, the movement of toner and electroconductive particles around the charging roller surface are described with reference to FIGS. 3 and 4 wherein toner particles 303*a* and 403*a* are depicted in a somewhat larger size than electroconductive particles 3022 and 4022 for easier understanding.

Figure 3:
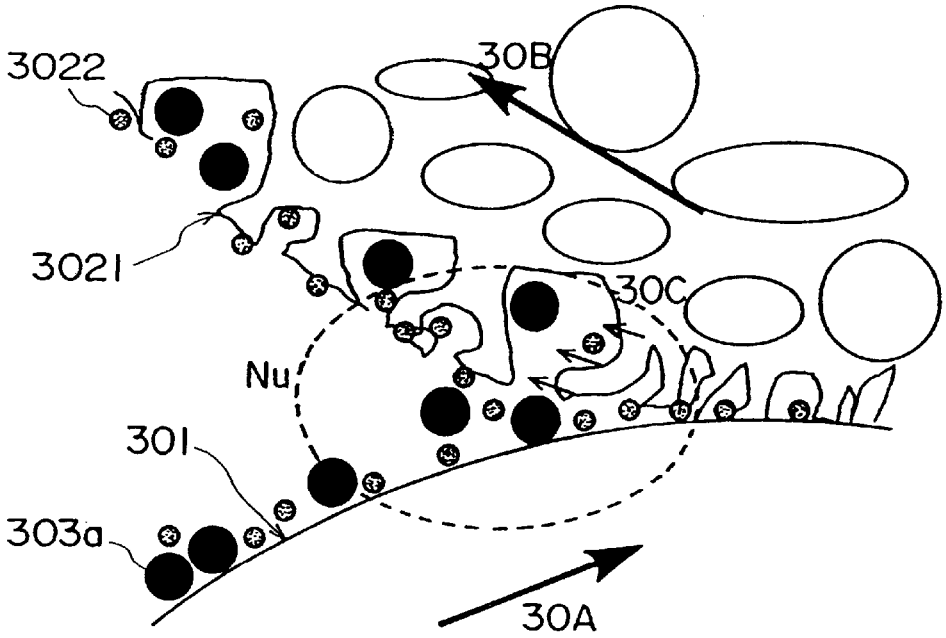
FIGS. 3 and 4 illustrate movement of toner particles, etc., at an entrance to and at an exit from the nip between the charging roller and the photosensitive member.

FIG. 3 shows a state wherein toner particles 303*a* and conductive particles 3022 (having slipped by or without being cleaned by a cleaning device) present on a photosensitive member 301 enter a region Nu upstream of a contact nip between the photosensitive member 301 and a charging roller 3021 in a direction 30A along with the rotation of the photosensitive member 301. On the other hand, the surface of the charging roller 3021 moves in an arrow 30B direction, so that the surface projections about the cavities of the elastic medium-resistivity layer are once bent to open the cavities and then sprung back in a direction of arrows 30C to rub the toner particles 303*a* and the conductive particles 3022 to triboelectrically charge the toner particles. This function is promoted if the cavity percentage and the cavity diameter are larger.

Figure 4:
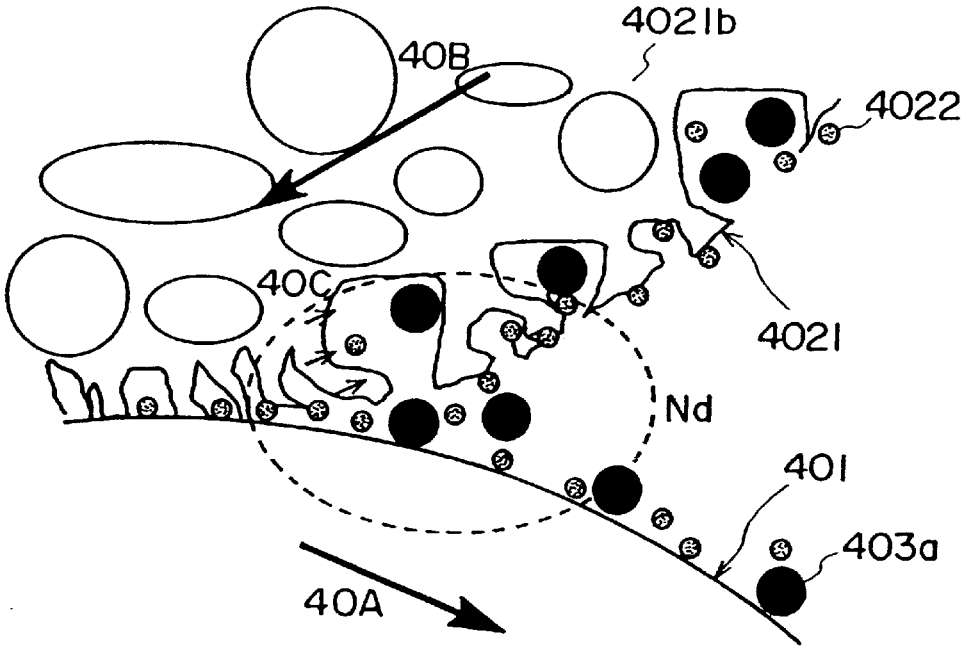

FIG. 4 illustrates a state of a region Nd downstream of the contact nip between the charging roller 4021 and the photosensitive member 401. The elastic medium-resistivity layer 4021*b* of the charging roller 4021 is moved in an arrow 40B direction to enter the region Nd downstream of the contact nip. In the region Nd, the toner particles are discharged onto the photosensitive member 401 because of their charge and a small potential difference between the charging roller 4021 and the photosensitive member 401 and also because of collapsion of the cavities in a direction of arrows 40C relative to the surface movement of the photosensitive member 401 in an arrow 40A direction.

Figure 5:
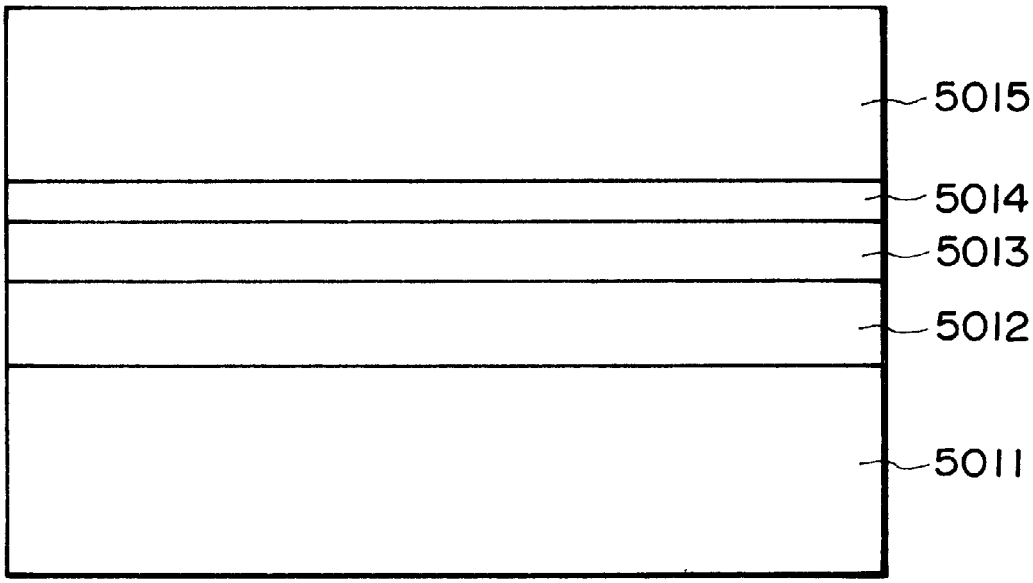
FIG. 5 illustrates a sectional view of an electrophotographic photosensitive member used in Examples 1–14 and Comparative Examples 1–5.

FIG. 5 illustrates a layer structure example of an ordinary electrophotographic photosensitive member comprising a support 5011 of, e.g., aluminum, and coating layers successively formed thereon including an undercoating layer 5012, a positive charge injection-preventing layer 5013, a charge generation layer 5014 and a charge transport layer 5015.

Figure 6:
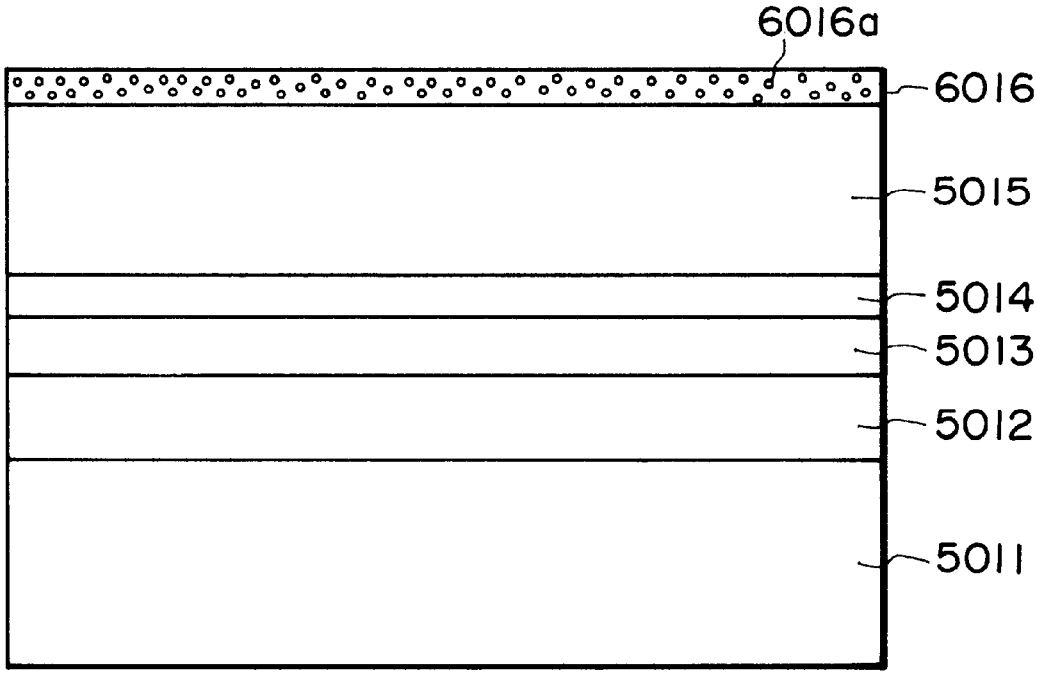
FIG. 6 illustrates a sectional view of an electrophotographic photosensitive member used in Example 15.
Figure 7:
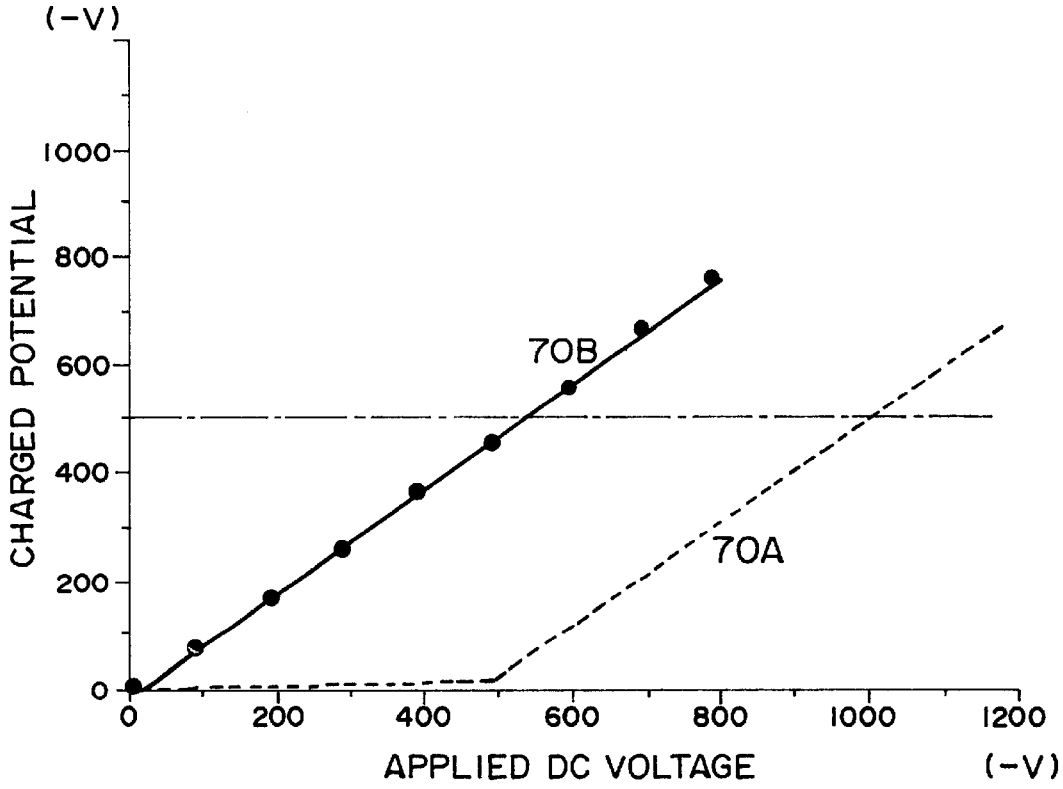
FIG. 7 is a graph illustrating charged potential-applied voltage characteristics of a conventional contact charging scheme (70A) and a direct-injection charging scheme (70B).

FIG. 6 illustrates a layer structure example of an electrophotographic photosensitive member further including a charge injection layer 6016 as a surface layer on the ordinary electrophotographic photosensitive member structure as illustrated in FIG. 5. The charge injection layer 6016 is a resistivity-adjusted surface layer allowing further stable and uniform charging. Even when the charging performance of the charging device is lowered, the effective charge transfer can be ensured by the presence of electroconductive particles and also the use of a photosensitive member having a surface resistivity within a range allowing latent image formation thereon.

According to an embodiment, the charge injection layer 6016 may be formed by preparing a paint by mixing and dispersion of a photocurable acrylic resin, $SnO_2$ ultrafine particles 6016*a* of, approximately 0.03 $\mu$m in diameter, a lubricant such as polytetrafluoroethylene fine powder, a polymerization initiator, etc., and applying the paint on the charge transport layer 5015, followed by photocuring. It is important for the charge injection layer to have a specifically controlled volume resistivity. A lower surface layer resistivity of the photosensitive member allows a more effective charge transfer. On the other hand, the surface layer is required to have a certain level of resistivity in order to retain an electrostatic latent image for a certain period. Accordingly, the charge injection layer 6016 may preferably have a volume resistivity of at most $1\times10^{14}$ ohm.cm, particularly in a range of $1\times10^{9}$–$1\times10^{14}$ ohm cm. The same effect can be attained without using a separate charge injection layer as far as the photosensitive member has a surfacemost layer having a volume resistivity falling within the above-mentioned range. For example, a similar effect is attained by using a photosensitive member having a surface layer of amorphous silicon having a volume resistivity of approximately $10^{13}$ ohm.cm.

Hereinbelow, the present invention will be described more specifically with reference to the following examples, which should not be construed to restrict the scope of the present invention in any way.

Example 1

An image forming apparatus having an organization as illustrated in FIG. 1 was prepared by remodeling a commercially available laser beam printer of 600 dpi ("LBP-1760", made by Canon K.K.) equipped with a process cartridge therefor ("EP-52", made by Canon K.K.). More specifically, the re-modeling was performed by changing the charging roller of the process cartridge ("EP-52") to a charging roller 1021 of the present invention and a conductive particle-supply member 108 prepared in a manner described below, and the charging roller drive mode from the photosensitive member-following type to a separate drive mode for providing a peripheral speed difference with the photosensitive member.

In the image forming apparatus shown in FIG. 1, the photosensitive member 101 was in the form of a 30 mm-dia. drum and rotated in the indicated arrow 10A direction at a constant peripheral speed of 94 mm/sec. The charging roller 1021 was rotated at 150 rpm so as to provide a peripheral speed at an identical speed in a reverse direction with respect to the photosensitive member 101 while being supplied with a DC voltage of −620 volts applied to the core metal 1021*b*.

The charging roller 1021 was prepared by coating a core metal 1021*b* of SUS with a medium-resistivity layer of elastic foam formulated as a mixture of urethane resin, conductive particles of carbon black, a foaming agent, etc. Thereafter the elastic foam layer was abraded to finish the medium-resistivity elastic foam layer 1021*a*, thereby providing a charging roller 1021 having a diameter of 12 mm and a length of 200 mm.

The charging roller prepared in this example had surface cavities exhibiting a cavity area percentage of 57% and an average cavity diameter of 120 $\mu$m. The charging roller further exhibited a resistance of 100 k.ohm.

Electroconductive particles 1022 comprising electroconductive zinc oxide particles having a volume resistivity of $10^3$ ohm.cm and an average particle size (agglomerated particle size) of 1.5 $\mu$m were uniformly applied on the charging roller 1021 surface.

Separately, a conductive particle chip 1081 as a conductive particle-supply member was prepared by mixing a 5 wt. % solution in ethanol of styrene-acrylate resin with the above-mentioned zinc oxide particles in an amount of 7 times the styrene-acrylate resin, and shaping the resultant liquid in a mold, followed by drying.

The conductive particle chip 1081 had a block shape, and was caused to attach the charging roller 1021 to supply the conductive particles to the charging roller surface in a period after image formation and be separated from the charging roller 1021 prior to image formation.

Continuous image formation was performed by using the above-prepared image forming apparatus having an organization shown in FIG. 1, and the resultant images were evaluated in the initial stage (1st sheet), after 100 sheets, after 5000 sheets and after 10000 sheets of the continuous image formation with respect to the following items.

a) Fog

Fog appears on a white background portion (non-exposed portion) like ground soil at parts of insufficient charge. For evaluation, the reflectance at non-image portion on a white recording paper after printing (Dw (%)) was measured, and the reflectance of the blank white paper ($D_B$ (%)) was measured, respectively by using an optical reflectance meter ("TC-6DS", made by Tokyo Denshoku K.K.) equipped with a green filter. A fog value was determined as a difference therebetween ($D_B$–$D_W$), and based on 10 fog values measured at different points, an average thereof was taken as a measured fog value. The evaluation was performed based on the average fog value according to the following standard.

A: <2%

A⁻: 2–10%

B: >10% b) Halftone

Charging failure in a minute region, i.e., charging non-uniformity, is rather noticeable at a halftone image, e.g., as minute black spots or black streaks, than the above-mentioned fog in the white background portion. Accordingly, the reproducibility of halftones were evaluated at two levels, i.e., a lower density level of one dot lateral line and two spaces and a higher density level of two dot lateral line and three spaces, respectively at a resolution of 600 dpi. The charging non-uniformity was rather noticeable at the lower density level. The evaluation was performed according to the following standard:

A: No black spots or no black streaks at either of the lower and the higher density levels.

A⁻: No black spots or no black streaks at the higher density level, and almost no black spots or black streaks at the lower density level.

B: Black spots or black streams were found at both higher and lower density levels.

The evaluation conditions and results are inclusively shown in Table 1 together with those of the following Examples and Comparative Examples.

Examples 2–15 and Comparative Example 1–5

Image formation and evaluation were performed in the same manner as in Example 1 except for changing the image forming apparatus (having an organization as shown in FIG. 1 or FIG. 2), the presence or absence of a charge injection layer, the cavity area percentage and average diameter of the charging roller, and the speed difference between the charging roller and the photosensitive member, respectively, as summarized in Table 1.

More specifically, in Examples 10–15, an image forming apparatus having an organization as illustrated in FIG. 2 was used after preparation by remodeling the commercially available laser beam printer of 600 dpi ("LBP-1760") equipped with the process cartridge therefor ("EP-52") by changing the charging roller of the process cartridge ("EP-52") to a charging roller 2021 coated with conductive particles 2022, the charging roller drive mode to a separate drive mode for providing a peripheral speed difference with the photosensitive member, the toner (for"EP-52") to a mixture of the toner and conductive particles 203*a* (2022) and omitting the cleaner (for "LBP-1760").

Incidentally, the charging rollers used in Examples 1–15 and Comparative Examples 1–5 were prepared while adjusting the surface cavity area percentage and cavity diameter in the following manner.

(Examples 1, 6–15 and Comparative Example)

The surface layer composition was prepared by mixing liquid urethane with a prescribed amount of electroconductive carbon black for resistivity adjustment and a foaming agent, and the composition was injected into a mold having a rough shape of the charging roller and already containing a core metal, followed by foaming and surface abrasion to form a charging roller. The cavity diameter and cavity area percentage were adjusted by changing the amount and particle size of the foaming agent.

(Examples 2–5 and Comparative Examples 1–4)

A molding composition was prepared by mixing liquid-soiubie particles with a urethane resin containing a prescribed amount of electroconductive carbon black for resistivity adjustment and shaped into a tube, which was then left standing in the liquid to elute the particles, thereby obtaining a tube-form foam body. A core metal was inserted into the tube under pressure, and thereafter the outer surface of the tube was abraded to form a charging roller. The cavity diameter and area percentage were adjusted by changing the particle size and amount of the liquid-soluble particles.

The evaluation conditions and evaluation results are inclusively shown in Table 1 below.

TABLE 1

| | Apparatus conditions | | | | | | | Continuous image forming performance | | | | | | | |
|---|---|---|---|---|---|---|---|---|---|---|---|---|---|---|---|
| | | | Charging roller surface cavities | | | Conductive particles | Roller-drum | Initial (1st sheet) | | After 100 sheets | | After 5000 sheets | | After 10000 sheets | |
| Example | Image forming apparatus* | Charge injection layer | areal ratio (%) | average diameter (μm) | b/a | Dav. (μm) | speed ratio (%) | Fog | Half-tone | Fog | Half-tone | Fog | Half-tone | Fog | Half-tone |
| 1 | FIG. 1 | None | 57 | 45.0 | 0.88 | 1.5 | −200 | A | A | A | A | A | A | A | A |
| 2 | FIG. 1 | None | 50 | 100 | 0.83 | 1.5 | −200 | A | A | A | A | A | A | A | A |
| 3 | FIG. 1 | None | 90 | 100 | 0.84 | 1.5 | −200 | A | A | A | A | A | A | A | A |
| Comp. 1 | FIG. 1 | None | 42 | 101 | 0.79 | 1.5 | −200 | A | A | B | B | B | B | B | B |
| Comp. 2 | FIG. 1 | None | 95 | 100 | 0.85 | 1.5 | −200 | A | B | B | B | B | B | B | B |
| 4 | FIG. 1 | None | 60 | 5 | 0.90 | 1.5 | −200 | A | A | A | A | A | A | A | A |
| 5 | FIG. 1 | None | 60 | 149 | 0.91 | 1.5 | −200 | A | A | A | A | A | A | A | A |
| Comp. 3 | FIG. 1 | None | 61 | 3 | 0.84 | 1.5 | −200 | A | A | A | B | B | B | B | B |
| Comp. 4 | FIG. 1 | None | 60 | 160 | 0.87 | 1.5 | −200 | A | B | A | B | A | B | A | B |
| 6 | FIG. 1 | None | 62 | 101 | 0.68 | 0.5 | −200 | A | A | A | A | A | A | A | A |
| 7 | FIG. 1 | None | 62 | 100 | 0.87 | 1.0 | −200 | A | A | A | A | A | A | A | A |
| 8 | FIG. 1 | None | 59 | 99 | 0.77 | 10 | −200 | A | A | A | A | A | A | A | |
| 9 | FIG. 1 | None | 60 | 101 | 0.90 | 15 | −200 | A | A | A | A | A | A | A | A |
| Comp. 5 | FIG. 1 | None | 61 | 100 | 0.67 | 1.5 | 0 | A | B | B | B | B | B | B | B |
| 10 | FIG. 2 | None | 75 | 30 | 0.77 | 1.5 | −200 | A | A | A | A | A | A | A | A |
| 11 | FIG. 2 | None | 61 | 15 | 0.92 | 1.5 | −200 | A | A | A | A | A | A | A | A |
| 12 | FIG. 2 | None | 60 | 20 | 0.85 | 1.5 | −200 | A | A | A | A | A | A | A | A |
| 13 | FIG. 2 | None | 60 | 99 | 0.86 | 1.5 | −200 | A | A | A | A | A | A | A | A |
| 14 | FIG. 2 | None | 59 | 121 | 0.92 | 1.5 | −200 | A | A | A | A | A | A | A | A |
| 15 | FIG. 2 | Yes | 60 | 80 | 0.69 | 1.5 | −200 | A | A | A | A | A | A | A | A |

*FIG. 1: Apparatus having an organization of FIG. 1.
FIG. 2: Apparatus having an organization of FIG. 2.

As shown in the above Table 1, good images were continually formed in each Example.

As has been described above, according to the present invention it has become possible to provide a charging device including a charging roller having surface cavities showing a high cavity area percentage and a small average cavity diameter, thus retaining the charging roller in a little-soiled state and exhibiting stable charging performance by stable injection charging free from the occurrence of discharge products. By including the charging device, it is also possible to provide an image forming apparatus capable of retaining stable image forming performances for a long period.

Particularly, even in an image forming apparatus adopting a cleanerless system, good images free from charging irregularity can be formed in a long period of image formation by adopting a stable injection charging scheme free from the generation of discharge products.

What is claimed is:

1. A charging device, including: an object to be charged, and a roller-shaped charging member disposed in contact with the object via electroconductive particles and adapted to be supplied with a voltage to charge the object, the charging member having a surface layer comprising an elastic foam and being adapted to be moved with a surface speed difference relative to the object, wherein the charging member has surface cavities having an average diameter of 5 to 150 μm and occupying an area percentage of 50 to 90%.

2. The charging device according to claim 1, wherein the electroconductive particles have a resistivity of at most $1\times10^{12}$ ohm.cm.

3. The charging device according to claim 1, wherein the electroconductive particles have an average particle size of at least 10 nm.

4. The charging device according to claim 3, wherein the average particle size of the electroconductive particles is at least 1/100 of the average diameter of the surface cavities.

5. The charging device according to claim 1, wherein the electroconductive particles have an average particle size of at most the average diameter of the surface cavities.

6. The charging device according to claim 5, wherein the average particle size of the electroconductive particles is at most 1/10 of the average diameter of the surface cavities.

7. The charging device according to claim 1, wherein the electroconductive particles have an average particle size of at least 1/100 and at most 1/10 of the average diameter of the surface cavities.

8. The charging device according to claim 1, wherein the object to be charged has a surface layer exhibiting a volume resistivity of at most $1\times10^{14}$ ohm.cm.

9. The charging device according to claim 1, wherein the charging member is rotated in a counter direction with respect to the object to be charged.

10. The charging device according to claim 1, wherein the object to be charged is an image-bearing member.

11. The charging device according to claim 10, wherein the image-bearing member is an electrophotographic photosensitive member.

12. The charging device according to claim 1, wherein the charging member has surface cavities having an average diameter of 20 to 100 μm.

13. A process cartridge, comprising an electrophotographic photosensitive member and a charging device including a roller-shaped charging member and integrally supported to form a cartridge which is detachably mountable to a main assembly of an image forming apparatus, wherein the charging device is disposed in contact with the photosensitive member via electroconductive particles and supplied with a voltage to charge the photosensitive member, the charging member has a surface layer comprising an elastic foam and is moved with a surface speed difference relative to the photosensitive member, wherein the charging member has surface cavities having an average diameter of 5 to 150 μm and occupying an area percentage of 50 to 90%.

14. The process cartridge according to claim 13, wherein the electroconductive particles have a resistivity of at most $1\times10^{12}$ ohm.cm.

15. The process cartridge according to claim 13, wherein the electroconductive particles have an average particle size of at least 10 nm.

16. The process cartridge according to claim 15, wherein the average particle size of the electroconductive particles is at least 1/100 of the average diameter of the surface cavities.

17. The process cartridge according to claim 13, wherein the electroconductive particles have an average particle size of at most the average diameter of the surface cavities.

18. The process cartridge according to claim 17, wherein the average particle size of the electroconductive particles is at most 1/10 of the average diameter of the surface cavities.

19. The process cartridge according to claim 13, wherein the electroconductive particles have an average particle size of at least 1/100 and at most 1/10 of the average diameter of the surface cavities.

20. The process cartridge according to claim 13, wherein the photosensitive member has a surface layer exhibiting a volume resistivity of at most $1\times10^{14}$ ohm.cm.

21. The process cartridge according to claim 13, wherein the charging member is rotated in a counter direction with respect to the electrophotographic photosensitive member.

22. The process cartridge according to claim 13, further including a developing means for supplying a developer containing the electroconductive particles.

23. The process cartridge according to claim 13, further including a developing means also functioning as a means for recovering a developer remaining on the electrophotographic photosensitive member.

24. The image forming apparatus according to claim 23, wherein the electroconductive particles have an average particle size of at least 10 nm.

25. The image forming apparatus according to claim 24, wherein the average particle size of the electroconductive particles is at least 1/100 of the average diameter of the surface cavities.

26. The process cartridge according to claim 13, wherein the charging member has surface cavities having an average diameter of 20 to 100 μm.

27. An image forming apparatus, comprising an electrophotographic photosensitive member, a charging device including a charging member disposed in contact with the photosensitive member via electroconductive particles and supplied with a voltage to charge the photosensitive member, exposure means for exposing the photosensitive member to light to form an electrostatic latent image on the photosensitive member, developing means for developing the electrostatic latent image with a developer to form a toner image on the photosensitive member, and transfer means for transferring the toner image onto a transfer receiving material, wherein the charging member has a surface layer comprising an elastic foam and is moved with a surface speed difference relative to the photosensitive member, wherein the charging member has surface cavities having an average diameter of 5 to 150 μm and occupying an area percentage of 50 to 90%.

28. The image forming apparatus according to claim 27, wherein the electroconductive particles have a resistivity of at most $1\times10^{12}$ ohm.cm.

29. The image forming apparatus according to claim 25, wherein the electroconductive particles have an average particle size of at most the average diameter of the surface cavities.

30. The image forming apparatus according to claim 29, wherein the average particle size of the electroconductive particles is at most 1/10 of the average diameter of the surface cavities.

31. The image forming apparatus according to claim 25, wherein the electroconductive particles have an average particle size of at least 1/100 and at most 1/10 of the average diameter of the surface cavities.

32. The image forming apparatus according to claim 25, wherein the photosensitive member has a surface layer exhibiting a volume resistivity of at most $1\times10^{14}$ ohm.cm.

33. The image forming apparatus according to claim 25, wherein the charging member is rotated in a counter direction with respect to the photosensitive member.

34. The image forming apparatus according to claim 25, wherein the exposure means is an exposure means emitting scanning laser light capable of digital exposure at individual pixels to form an electrostatic latent image on the electrophotographic photosensitive member, and the average particle size of the electroconductive particles is at most a diameter of each pixel.

35. The image forming apparatus according to claim 25, wherein the developing means supplies a developer containing the electroconductive particles.

36. The image forming apparatus according to claim 25, wherein the developing means also functions as a means for recovering a developer remaining on the electrophotographic photosensitive member.

37. The image forming apparatus according to claim 25, wherein the charging member has surface cavities having an average diameter of 20 to 100 μm.

* * * * *

UNITED STATES PATENT AND TRADEMARK OFFICE

CERTIFICATE OF CORRECTION

PATENT NO. : 6,553,199 B2
DATED : April 22, 2003
INVENTOR(S) : Harumi Ishiyama et al.

It is certified that error appears in the above-identified patent and that said Letters Patent is hereby corrected as shown below:

Column 16,
Line 55, “soiubie” should read -- soluble --.

Column 17,
Table 1, “areal” should read -- area --.

Signed and Sealed this

Eleventh Day of November, 2003

JAMES E. ROGAN
*Director of the United States Patent and Trademark Office*